US008777667B2

(12) United States Patent
Huang et al.

(10) Patent No.: US 8,777,667 B2
(45) Date of Patent: Jul. 15, 2014

(54) ELECTRICAL CONNECTOR WITH SHELL INTERFERENTIALLY ENGAGED WITH PORTION OF THE CONNECTOR

(75) Inventors: Lin Huang, ShenZhen (CN); Yu-San Hsiao, Tu-Chen (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 1018 days.

(21) Appl. No.: 12/287,931

(22) Filed: Oct. 14, 2008

(65) Prior Publication Data

US 2009/0124124 A1 May 14, 2009

(30) Foreign Application Priority Data

Oct. 12, 2007 (CN) ..... 2007 2 0043641 U

(51) Int. Cl.
*H01R 13/648* (2006.01)

(52) U.S. Cl.
USPC ..... 439/607.35; 439/607.53

(58) Field of Classification Search
USPC ..... 439/607.01, 607.35, 607.53, 607.54
See application file for complete search history.

(56) References Cited

U.S. PATENT DOCUMENTS

| | | | | |
|---|---|---|---|---|
| 6,383,023 | B1 * | 5/2002 | Chang et al. | 439/607.35 |
| 7,331,822 | B2 | 2/2008 | Chen n | |
| 7,445,503 | B1 * | 11/2008 | Zhang | 439/607.01 |
| 7,445,504 | B1 * | 11/2008 | Zhang | 439/607.01 |
| 2005/0095917 | A1 * | 5/2005 | Miyamoto | 439/630 |
| 2006/0160399 | A1 | 7/2006 | Dawiedczyk et al. | |
| 2006/0189199 | A1 * | 8/2006 | Lang et al. | 439/374 |
| 2007/0173118 | A1 * | 7/2007 | Chen | 439/607 |
| 2008/0020640 | A1 | 1/2008 | Zhang | |
| 2008/0182456 | A1 * | 7/2008 | Zhang | 439/626 |

* cited by examiner

*Primary Examiner* — Vanessa Girardi
(74) *Attorney, Agent, or Firm* — Wei Te Chung; Ming Chieh Chang

(57) ABSTRACT

An electrical connector (1) is adapted for mounting to a circuit substrate having a metallic shell (2) assembled onto an insulated housing (3). The metallic shell (2) has a base portion with two side-walls (23) and a pair of arms (24) extending from the side-walls (23). Some interferential tabs (243) are introverted on both of the arms (24) and corresponding slots (311) are formed on the insulated housing (3). When assembling, the interferential tabs (243) are engaged with corresponding slots (311) to firmly fit the metallic shell (2) and insulated housing (3) together.

1 Claim, 5 Drawing Sheets

ELECTRICAL CONNECTOR WITH SHELL INTERFERENTIALLY ENGAGED WITH PORTION OF THE CONNECTOR

BACKGROUND OF THE INVENTION

1. Field of the Invention

The present invention relates to an electrical connector, and more particularly, to an electrical connector with a metallic shell interferentially engaged with a portion of the connector.

2. Description of Related Art

The SFF Committee is an ad hoc group formed to address storage industry needs in a prompt manner. One kind of connector named Mini SAS connector adapted for high-speed transmission has been defined by the SFF Committee. Several types of utility Mini SAS connectors have been launched and U.S. Pub. No. 2006/0160399 A1 discloses such kind of connector. The connector includes a connector guide made of metallic sheet and located in front of an insulated housing. The connector guide and the insulated housing are separately mounted on a circuit substrate. When mounting onto the printed circuit board, the relative position between the connector guide and the insulated housing is loosely controlled, and the assemble process is heavy and complicated.

U.S. Pat. No. 7,331,822 B2 issued to Amphenol on Feb. 19, 2008 discloses another receptacle for a pluggable module including a conductive housing having two side walls and a metallic shell assembled onto the conductive housing with a barb 24 and a engaging portion 15. In this way, the conductive housing and the metallic shell can join together. However, the fixation of elastic lock may affect the stability of new combination and it is still hard to fix the conductive housing and the metallic shell firmly.

Hence, an improved electrical connector with a firm fixed metallic shell is highly desired to overcome the disadvantages of the related arts.

SUMMARY OF THE INVENTION

Accordingly, the object of the present invention is to provide an electrical connector with improved structure to make it firm and convenient to assemble a metallic shell to an insulated housing.

In order to achieve the object set forth, an electrical connector in accordance with the present invention is adapted for mounting to a circuit substrate having a metallic shell assembled onto an insulated housing. The metallic shell has a base portion with two side-walls and a pair of arms extending from the side-walls. Some interferential tabs are introverted on both of the arms and corresponding slots are formed on the insulated housing. When assembling, the interferential tabs are engaged with corresponding slots to firmly fit the metallic shell and insulated housing together.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
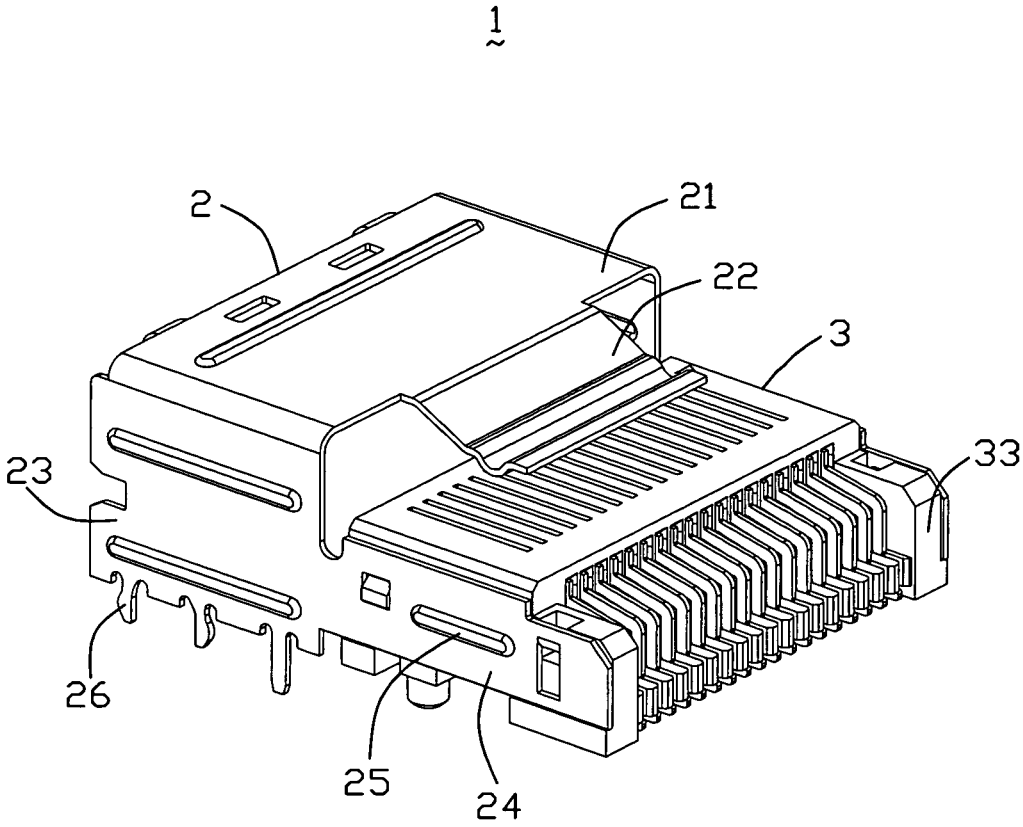
FIG. 1 is an assembled, perspective view of the electrical connector of an embodiment of the present invention.
Figure 2:
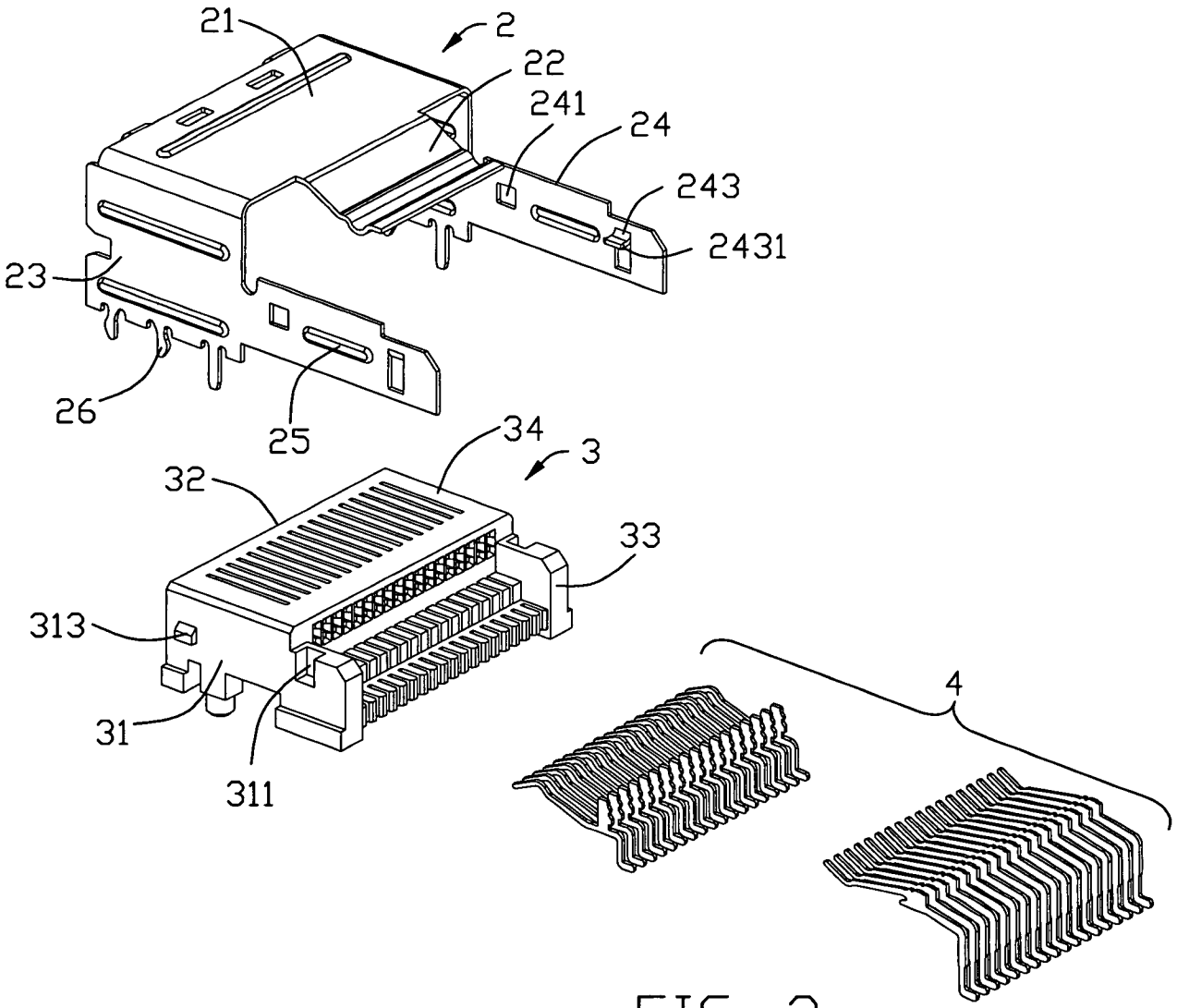
FIG. 2 is an exploded, perspective view of the electrical connector as shown in FIG. 1.

Referring to FIGS. 1-2, an electrical connector 1 for mounting on a circuit substrate (not shown) in accordance with the embodiment of the present invention comprises an insulated housing 3, a plurality of terminals 4 received in the insulated housing 3, and a metallic shell 2 assembled onto the insulated housing 3.

Figure 5:
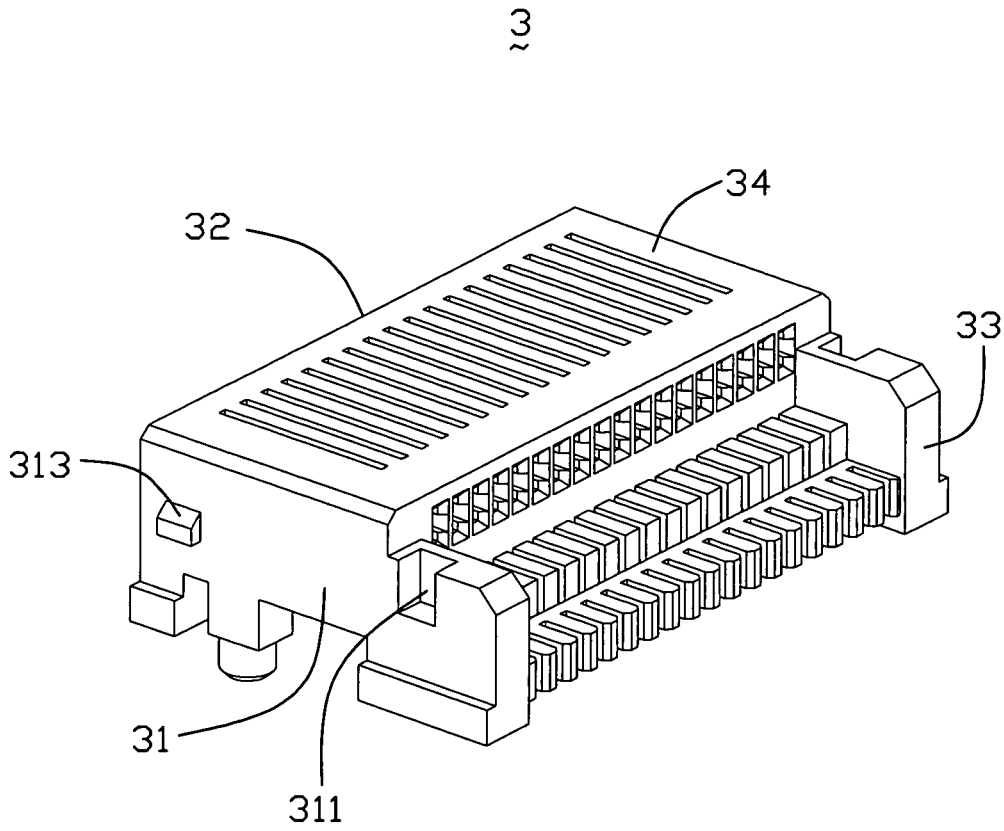
FIG. 5 is a perspective view of the insulated housing as shown in FIG. 2.

Referring to FIG. 5, the insulated housing 3 comprises a mating face 32, a rear face 33, a top face 34 and a pair of side-faces 31 interconnecting with the mating face 32, the rear face 33 and the top face 34. Vertical slots 311 and projections 313 are formed on the both side-faces 31 symmetrically to lock with said metallic shell 2. Said vertical slots 311 are hollowed from the top-face 34 and opening with the side-faces 31.

Figure 3:
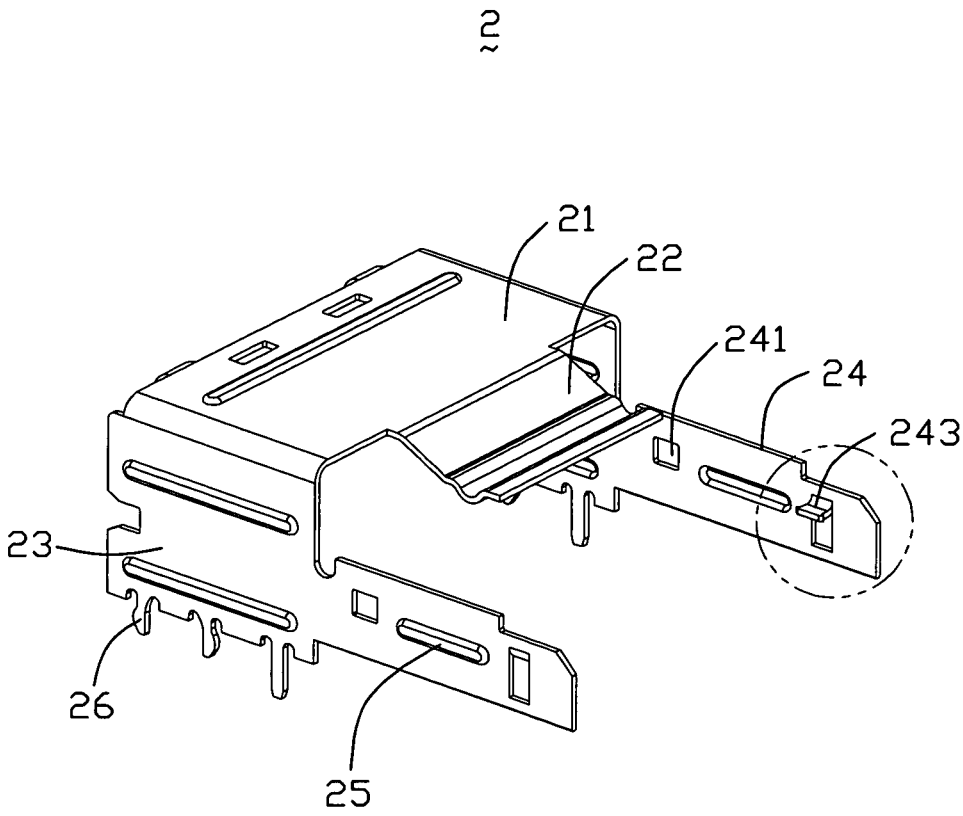
FIG. 3 is a perspective view of the metallic shell as shown in FIG. 2.
Figure 4:
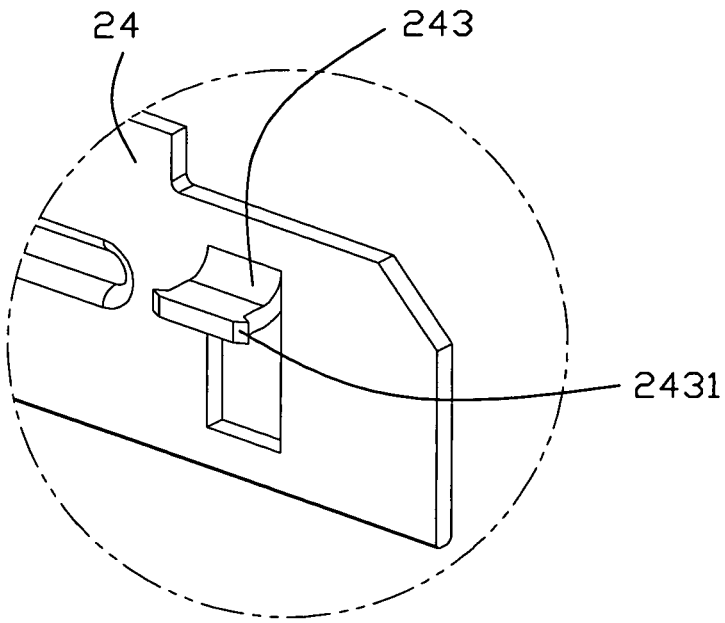
FIG. 4 is an enlarged, perspective view of the interference tab as shown in FIG. 3.

Referring to FIGS. 2-4, The metallic shell 2 having a base portion defining a first receiving space therein, and a pair of arms 24 extending from the base portion and defining a second receiving space therebeween. Said insulated housing was assembled in the second receiving space, and said first receiving space is surrounded by a top-wall 21, a pair of side-walls 23 linked by the top-wall 21. A spring member 22 firstly extending rearward and downwardly from middle part of rear edge of the top-wall 21, then extending rearward and upwardly to form a lowest pressing portion that face to face with the top-face 34 of the insulated housing 3. Introverted interference tabs 243 were defined on the free end of said arms 24, and the end 2431 of the interference tabs 243 are a little wider than corresponding vertical slots 311 so as to make interference.

Referring to FIGS. 1-5, when assembly, the insulated housing 3 is in the second receiving space between two side-walls 23, and said first receiving space defines a guiding space for opposing connector. The through hole 241 of the metallic shell 2 locked with the projection 313 of the insulated housing 3 elastically, and the interference tabs 243 of the metallic shell 2 inserted into corresponding vertical slots 311 of the insulated housing 3 to make a firm fix. Protruding bar 25 is formed between the through hole 241 and the interference tab 243 to strengthen the side-walls 23, and elastic board locks 26 are formed on the second receiving space to assemble onto the circuit substrate easily.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a mating port exposed to an exterior through a front mating face, and two side faces rearwardly extending from two opposite sides of the front mating face;

a metallic shell assembled to the housing and including an upside down U-shaped main body including a top wall and two side walls and located in front of the front mating face of the housing under a condition that said top wall of said main body is higher than the housing;

a spring member unitarily extending rearwardly from a rear edge of the top wall toward the housing; and a pair of extension arms unitarily extending rearwardly from rear edges of said two opposite side walls of the main body; wherein fastening means is formed on each extension arm and each corresponding side face for fastening the extension arm and the corresponding side face together under a condition that said fastening means is configured to only allow assembling between the shell and the housing in a vertical direction; wherein the housing includes a plurality of downwardly extending posts, and the shell includes a plurality of downwardly extending board locks in front of the downwardly extending posts; wherein each extension arm further includes a horizontal interference tab, and the housing defines a pair of vertical slots each securely receiving the corresponding horizontal interference tab therein.

* * * * *